US005706732A

United States Patent [19]

Rebeaud

[11] Patent Number: 5,706,732

[45] Date of Patent: Jan. 13, 1998

[54] DEVICE FOR LOADING METALLIZED BELTS INTO A MACHINE FOR TRANSFERRING METALLIZED IMAGES ONTO SHEET ELEMENTS

[75] Inventor: Jean-Claude Rebeaud, Le Mont-sur-Lausanne, Switzerland

[73] Assignee: Bobst SA, Lausanne, Switzerland

[21] Appl. No.: 639,736

[22] Filed: Apr. 29, 1996

[30] Foreign Application Priority Data

Apr. 28, 1995 [CH] Switzerland ..... 01223/95

[51] Int. Cl.[6] ..... B41F 13/00

[52] U.S. Cl. ..... 101/477; 101/DIG. 31; 101/216

[58] Field of Search ..... 101/415.1, 477, 101/216, DIG. 31; 400/234, 613, 692

[56] References Cited

U.S. PATENT DOCUMENTS

| | | | |
|---|---|---|---|
| 1,737,593 | 12/1929 | Lange | 101/DIG. 31 |
| 4,860,028 | 8/1989 | Ogawa | 400/234 |
| 4,860,031 | 8/1989 | Lejcek | 400/613 |
| 5,230,576 | 7/1993 | Sone | 400/692 |
| 5,402,727 | 4/1995 | Matsuo et al. | 101/486 |
| 5,415,485 | 5/1995 | Marenger | 400/613 |
| 5,460,092 | 10/1995 | Beisel et al. | 101/477 |
| 5,483,892 | 1/1996 | Stiel | 101/477 |

*Primary Examiner*—Christopher A. Bennett
*Attorney, Agent, or Firm*—Hill, Steadman & Simpson

[57] ABSTRACT

A device for unloading metallized belts comprises a pair of parallel arms rotatably mounted respectively between each of two lateral side walls of the last station of the machine. The arms are connected to one another by crossbeams, which may accept support levers for small-diameter bobbins. Each arm has a base plate for supporting the ends of the axles for the large-diameter bobbins. The device includes an arrangement for rotating the sub-frame formed by the arms from the operating position to an extended position, which has a portion of the arms extending out of the downstream end of the machine to enable exchanging bobbins.

8 Claims, 2 Drawing Sheets

79
54
30
32
34
36
56
51
52
53
100
39
38
37
14
66
64
62
50
22
58
60
57
55
24
70
71
72
73
74
75
76
50'
77
12
10
20

DEVICE FOR LOADING METALLIZED BELTS INTO A MACHINE FOR TRANSFERRING METALLIZED IMAGES ONTO SHEET ELEMENTS

BACKGROUND OF THE INVENTION

The present invention is concerned with an arrangement or device for loading metallized belts into a machine for transferring metallized images onto sheet elements, such as sheets of cardboard, paper or plastic material. More particularly, the invention concerns the arrangement or device used in a platen press, which press comprises an upper fixed supporting platen and a lower mobile supporting platen, between which platens the cardboard sheet is fed so that the metallizing film coming from a belt or band conducted between the sheet and one of the platens can be printed onto the sheet according to a particular pattern or patterns.

A platen press of this type usually comprises, first, an input station in which is installed a stack of sheets. Each sheet is successively removed from the top of the stack in order to be sent to a layout board on which each sheet is placed in position against front stops and lateral stops before a front edge of the sheet is grasped by a series of clamps or gripping fingers mounted along a transverse bar, which has its ends attached to lateral chain trains leading the bar and, thus, the sheet into the subsequent processing stations. The processing stations may be a station for transferring the metallized film, possibly combined with curing tools, followed by a waste ejection station. These processing stations are finally followed by a delivery station in which each sheet is released by the gripping fingers or clamps and falls squarely onto the top of a stack that accumulates on an output pallet.

An independent transport arrangement for parallel metallized belts or bands successively comprises a support for the belt bobbins, means for intermittently unrolling and advancing the belts, guiding means for guiding these belts in a parallel fashion in the direction of the movement of the sheets between the platens and then guiding them in a disengaged state around one of the platens of the press, tension means for placing each belt under tension at least along their trajectory between the platens, and an arrangement for the removal of worn belts from the machine, usually through a lateral window in a side of the machine. The metallized belts which have identical speeds of intermittent unwinding pass through the same advancing and unrolling means, while the belts having a different speed pass through second or even third separate unrolling and advancing means. The tension mechanism or means is controlled, in this case, as a function of the highest speed of unwinding.

A relatively heavy bobbin, which has a large width and radius, for example in the order of a width of 20 cm by a radius of 20 cm, is preferably installed on a traversing rigid axle held on each side in a corresponding base plate provided in the lateral wall of the machine. On the axle, the bobbin is gripped between two braking disks, one of which is pressed by a controlled elastic means. Thus, the unwinding takes place in a controlled manner against a certain frictional force, which enables the geometry of the bobbin to be correctly maintained at all times.

A smaller bobbin, for example 7 cm wide by 10 cm in radius, is first pressed onto a small axle situated at the end of a support lever. This small axle is fixedly attached to one or several small braking disks that rub against the fixed disks of the lever under pressure from a spring, whose force is controllable. The other end of the lever is fixed at a chosen position along a graduated crossbeam permanently installed in the machine.

For reasons of cumbersomeness, the base plates of the axles for traversing large bobbins and/or the graduated crossbar or crossbeam, which support the small bobbins, are situated in an upper part of the station following the station for the transfer of the metallized film and close to the rollers for the intermittent unwinding and advancing of the belts. A difficult access to this part of the machine makes the replacement of the belts in the course of production or the changing of the configuration of the belts from one production run to the next run very tiresome as well as time-consuming, which correspondingly increases the "dead time" during which the machine is not in use as well as increases the risk of accidents.

SUMMARY OF THE INVENTION

The object of the present invention is to provide an arrangement or device for loading metallized belts or bands in a machine for transferring metallized images onto sheet elements which is effective and which permits an easy, rapid and sure loading of the belts at a point in which they can be unwound with no special problems. The design of the device must remain simple in order to ensure better long-term reliability and a reasonable cost for constructing the device.

These objects are achieved by a sub-frame formed by two laterally parallel extending arms, which are connected to one another by at least one crossbeam, a sub-frame mounted with the parallel arms being disposed adjacent the two lateral internal walls of the last station of the machine, a crossbeam of the sub-beam adapted to accept holding levers for small bobbins, each arm having at least one base plate for the transverse bobbin support axle, as well as means for the rotational driving the sub-frame from a retracted position with the arms within the frame of the machine around an axis to an extended position in which a portion of the parallel arms projects at least partially out of the downstream end surface of the machine.

Preferably, the rotational mounting of the sub-frame has the arms mounted on an axle which is situated slightly above and downstream from a downstream return wheel for the transport chains for the clamping bars and the retracted position is approximately horizontal, oriented in an upstream direction. The extended position is reached after rotation of the subframe around the axis through an angle between 120° and 2000° upward and in a downstream direction of the machine. The pair of arms thus comprises at least one pair of base plates and a crossbeam, respectively, in its median part and at its other end.

Advantageously, the arms are separated at their median part into two branches, of which one, regarded when the arms are in the retracted position within the machine, is approximately horizontal, and the other is oriented upward in a direction approximately parallel to the path of the clamping bars as they leave the return wheel. This orientation of the second branch upward, as well as in the direction of the path of the clamping bars, forms an angle of between 45° and 80° in relation to the horizontal direction. It is thus possible to provide at least three support crossbeams for the levers and three pairs of base plates for the bobbin support axles, one at each end of the two branches and one at the branching point therebetween.

Advantageously, each arm presents a U-shaped curve, forming a scalloped recess between the axis of rotation and the adjacent branching point. This configuration enables the increasing of the outgoing rotational angle by extending around the clamping bar, which is stopped at a point of the axle of rotation for the arms.

According to the preferred embodiment, the base plates have a trapezoidal shape comprising, as regarded when the arms are in the retracted position, a lower edge making an angle on the order of 45° with the horizontal, a downstream edge making an angle on the order of 100°, an upper edge making an angle on the order of 15° and a downstream open outward surface. The ends of the rigid bobbin support axles then preferably present a triangular cross section. Due to this configuration, the axle ends are easily positioned in the base plates, remain there during the entire rotation of the arms between the retracted and extended position, and are fixed between the lower and downstream angular edges in a working position. This trapezoidal shape of the base plate can be easily obtained on the basis of a rectangular notch provided with small lateral bars that extend at 45° and are fixed against the surface of the branches by screws. This implementation of the base plate additionally enables, in the extended position of the arms, a removal of the bobbin supports without having to disassemble any holding parts.

The drive means may be an electric motor mounted in the upper part of one of the lateral walls of the last station of the machine, whose output axle is connected by a chain or belt to a notched driving wheel fixedly connected to the rotational axle of the arm situated near the same surface. If desired, this driving can be geared down by a wheel fixedly attached to an intermediate gear and the wheel being connected to the outgoing axle of the motor by an external chain or belt. The gear is connected to the drive wheel of the rotational axle of the arm by a chain or a gear wheel. The driving wheel of the axle of the arm, or the intermediate wheel, is usefully separated from a second wheel, whose periphery forms a double-cam acting on two contacts, whose position is adjustable. One of the contacts defines the retracted position of the arm, while the other defines the extended position. The ends of the lower branches also usefully rest on stops in the retracted position within the machine frame.

Other advantages and features of the invention will be readily apparent from the following description of the preferred embodiments, the drawings and claims.

DESCRIPTION OF THE PREFERRED EMBODIMENTS

Figure 1:
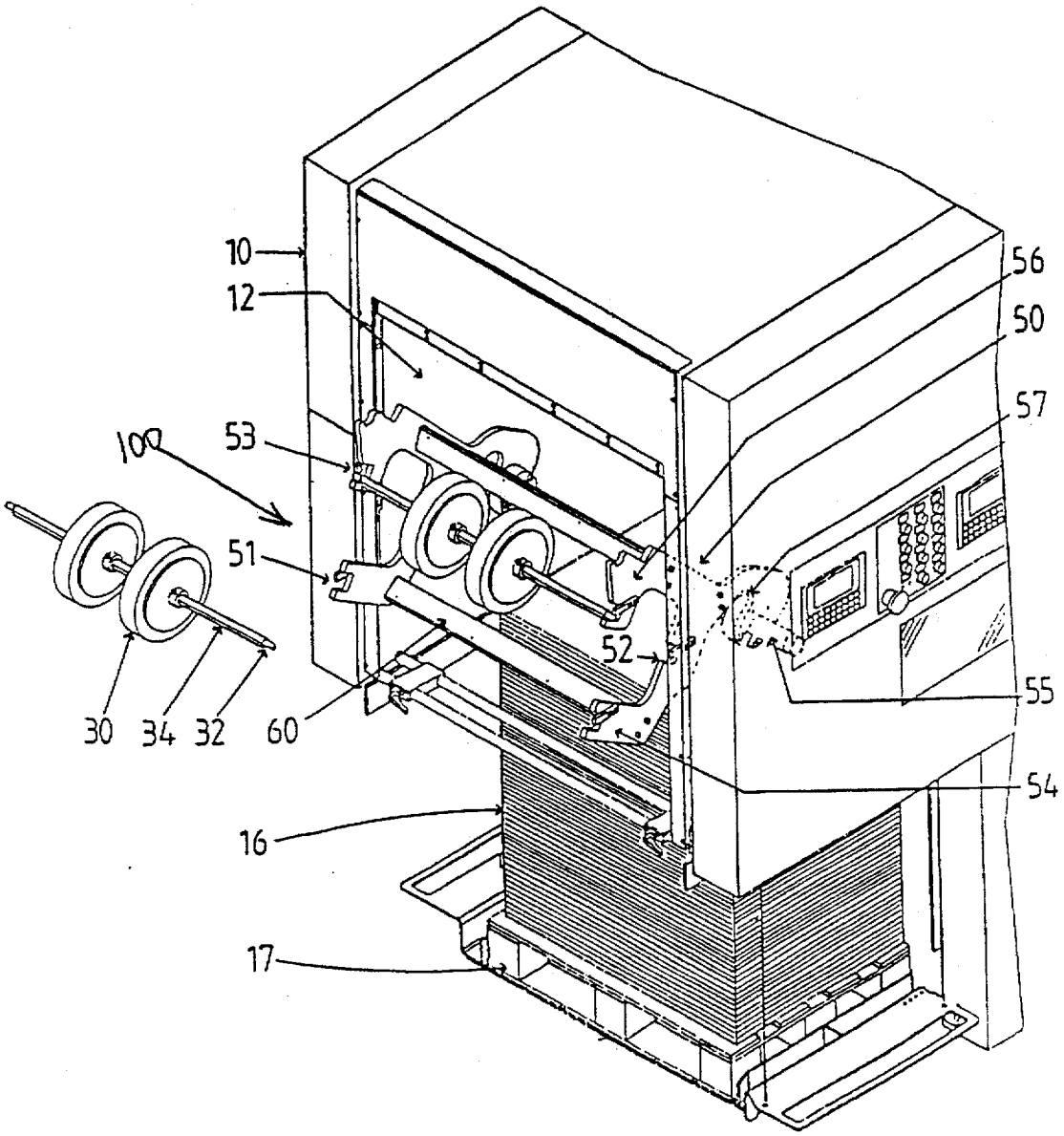
FIG. 1 is a schematic perspective view of a last station of a machine for transferring metallized images onto sheet elements.
Figure 2:
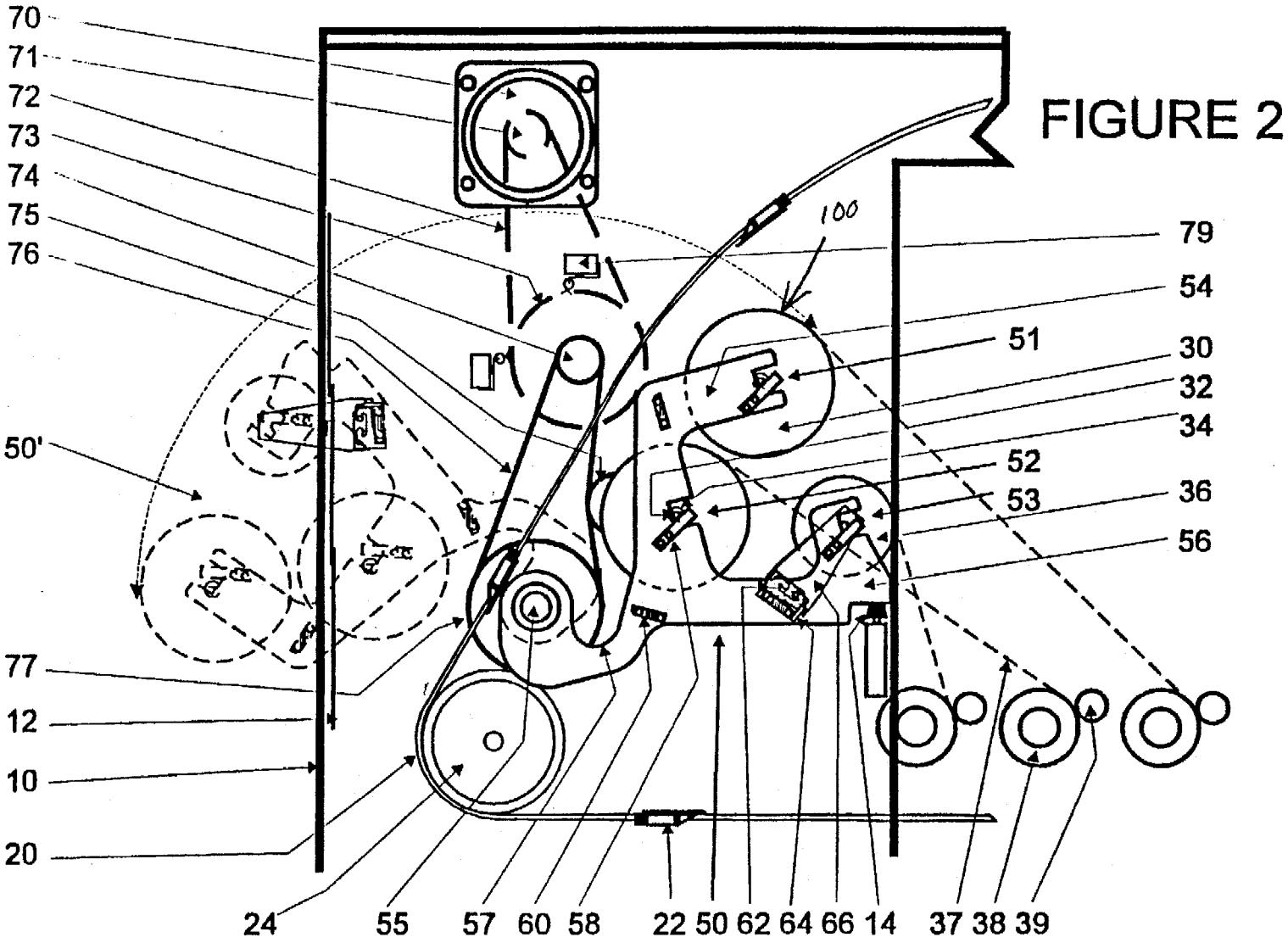
FIG. 2 is a schematic side view of the loading arrangement in accordance with the present invention.

The principles of the present invention are particularly useful in a loading arrangement, generally indicated at 100 in FIGS. 1 and 2. As illustrated, the loading arrangement is situated at the last station of a machine for transferring metallized images onto sheet elements, in this case a receiving or delivery station 10. In this station, clamping bars 22 (see FIG. 2), fixedly attached to chain trains 20 on each end, will transport sheets made of cardboard in the present example, through the machine. These sheets are released between angle irons and fail vertically onto a stack 16 (FIG. 1 ) that progressively forms on an output pallet 17. As illustrated in FIG. 2, after releasing the sheet, the chains 20 will carry the bars 22 with the clamping elements around a wheel 24 and then upward so as to be returned to the front of the machine.

In the present invention, the upper part of the station 10 is raised in order to create a supplemental space where the arrangement or device 100 of the present invention can be housed. In particular, the chain train 20 extends upwardly in the usual manner at an angle to a horizontal plane of the machine, with the angle being greater than 45° and, as illustrated, approximately 60°.

As shown in these Figures, the belt loading arrangement or device is based on a pair of identical lateral arms 50, which are held parallel to one another by a series of crossbeams 60 to form a sub-frame. The lower end of each of these lateral arms 50 are rotationally maintained by an axle 55 adjacent the internal surfaces of lateral wails of the corresponding upper part of the station 10. The rotation of the lateral arms 50 takes place in a plane parallel to these lateral walls.

As best shown in FIG. 2, the lateral arms may thus be turned from a retracted position within the machine, which is the operating position, and is shown in bold lines in FIG. 2 to an extended position 50' shown in broken lines with a portion of the arms extending out of the opening of the frame, which opening is closed by a door 12 having telescopic panels.

The lateral arms 50 present the general shape of a Y. As can be seen in the retracted position in FIG. 2, these arms separate at a median part into a lower branch 56, which extends approximately horizontal, and an upper branch 54 forming a bend that is first oriented almost vertically upward and then oriented in a downstream direction of the machine at an angle of approximately 20°. A common part, for example the one making the connection between the branching points of the branches 54 and 56 with the axle 55, forms a downwardly extending U-shaped portion or bend, which forms a recess 57, which opens upwardly.

With this configuration, the lateral arms present three base plates 51, 52 and 53 for the support of the three axles 34 of the metallized belt bobbins. The upper base plate 51 is arranged at the end of the upper branch 54. The median base plate 52 is near the branching point between the upper branch 54 and the lower branch 56, and the lower base plate 53 is provided at the end of the lower branch 56.

Three crossbeams 60, which extend between the two arms 50, are provided between the upper branches 54 and between the lower branches 56 and set back from the base plates 51 and 52, as well as 53, by a distance corresponding to the length of the levers 66, which may be provided for support of small-diameter bobbins 36 by means of an orthogonal axle. The crossbeams 60 also serve as support for these levers. Each support lever 66 is firmly attached at its lower part to a hooking block or mounting block 62 that is hooked or mounted onto an upper surface of the crossbeam 60 at any position along a graduated rule provided thereon. The hooking block 62 will be locked into a chosen position by a plate 64 fixed to the block by means of a threaded fastener or screw.

As shown, each of the base plates 51, 52 and 53 presents a trapezoidal transversalshaped opening which is obtained through the presence of a small bar 58 that extends into a rectangular notch at an angle on the order of 45° to 60°. These base plates, thus, present a lower edge, oriented obliquely downward, that encounters a downstream edge inclined on the order of 100° and topped by an upper edge inclined on the order of 15° in relation to the horizontal. The downstream part is thus open. These trapezoidal base plate openings are provided in order to accept the ends 32 of the support axles 34 for the large-diameter bobbins 30, and which ends 32 have a triangular cross section.

As noted above, if small bobbins are to be utilized, then the axle 32 with the large bobbins is replaced by the axle 36 with the small bobbins, which axle 36 is mounted on the lever arms 66, which have been attached to one of the crossbeams 60. The lever arms have a length so that the axle 36 will be in approximately the same position as the axle 34, which is being replaced.

The right lateral wall of the station 10, as seen according to the direction of movement of the sheets, and commonly called the conducting opposite side, supports an electric motor 70 on its upper part. The output axle 71 of this motor is connected by an external chain 72 to an external toothed intermediate wheel or gear 73. The wheel 73 is connected by an axle that traverses the wall to an interior gear 74 which, in turn, is connected to a toothed gear 77 for rotating the axle 55 of the arm 50 by a chain or notched belt 76, which is held under tension by a tension idler 75.

The external wheel 73 is combined with a disk whose periphery forms a double-cam acting in correspondence with a pair of microswitches or interrupters 79, which will determine the two extreme positions for rotation. These positions correspond respectively to the retracted position 50 illustrated in bold lines in FIG. 2 and the extended position 50' of the arms. Preferably, the downstream end of the lower branch 56 rests on a stop 14, reducing any incidence due to subsequent excessive tension in the unwinding of the belts.

In operation, when one or several of the bobbins 30 or 36 are almost empty, the printing machine is stopped, one of the clamp bars 22 being located almost at the level of the axle 55 of the arms 50. The switch of the control button is then turned to the "extended" position to first activate the lifting of the telescopic door 12 covering the window. The motor 70 then engages in order to drive the chains 72 and 76 so as to impart a rotation to the structure or subframe made up of the two arms 50 and the crossbeams 60, with the rotation being oriented in a downstream direction at an angle in the order of 130° in order to move the structure into the extended position 50'. This large angle is, in particular, made possible by the scalloping recess 57 that fits around the clamping bar 22, as shown in broken lines.

As is more clearly shown in FIG. 1, the device, in the extended position, enables a simple unloading and loading of the rigid axles 34 beating new bobbins 30, by installing their triangular ends 32 in the base plates 51, 53, which have respectively become the lower base plate and the upper one, or in the median base plate 52. Alternatively, it is also very easy to hook a hooking block of the levers 66 in any position along a directly accessible graduated rule of a crossbeam 60.

Once this loading has been carried out, the control button is placed in a "retracted" position, which again activates the motor to rotate in the reverse direction, which will impart to the arms a rotational orientation into the downstream direction in the machine. The motor 70 is automatically stopped when the corresponding interrupter 79 is tripped. In this position, the end of the lower branches 56 are again supported against the stop 14. By means of a lateral window belonging to the transfer station, the operator can thus easily gain access to the bobbins in order to unwind the belts 37 and pass them around the unrolling and advancing rollers 38 before engaging the corresponding pressure idlers 39.

In association with this loading arrangement according to the invention, there are provided, in particular, three pairs of unrolling and advancing rollers 38 and pressure idlers 39: one pair of each unrolling speed corresponding to the specific consumption of the metallized belt being handled. Preferably, these rollers are arranged in a horizontal plane immediately and slightly above the plane of the passage of the sheets in the machine, and this plane usually is situated at the height of the waist or even the arms of the operator. This height corresponds, in particular, to that of the lower edge of the window provided in each lateral wall of the next-to-the-last station.

As can be learned hereinabove, the arrangement according to the present invention enables very easy unloading and loading of the metallized belt bobbins through the downstream terminal surface or end of the machine. Once these bobbins have been reinserted in the machine by rotation of the device into its retracted operating position, the operator can easily unwind the belts and engage them in the intermittent advance rollers, by working through the lateral window of the next-to-the-last station. The accessibility being thus greatly improved, the operation is made much more rapid and sure to an extent corresponding to the increased simplicity.

Moreover, as is shown more clearly in FIG. 2, the dimensioning of the arms, as well as their thickness on the order of 20 mm, identical to the crossbeam 60, has the result that the structure is absolutely solid and rigid and can, thus, withstand any parasitic vibrations. In addition, this structure is simple to produce.

Although various minor modifications may be suggested by those versed in the art, it should be understood that I wish to embody within the scope of the patent granted hereon all such modifications as reasonably and properly come within the scope of my contribution to the art.

I claim:

1. A machine for transferring metallized images onto sheet elements selected from a group consisting of sheets of cardboard, paper and plastic material, said machine comprising a frame with a series of stations with a last station having inner side walls, means for transporting sheets through the machine between the stations including a chain train with clamping bars and a return wheel mounted in the last station, and a device for unloading metallized belts, said device including a sub-frame formed by a pair of parallel arms and at least one crossbeam extending therebetween, with the parallel arms being adjacent the inner side walls of the last station of the machine, said sub-frame being mounted for rotation around a fixed axis in the machine, each of the arms having at least one base plate for supporting ends of an axle for a bobbin, drive means for rotating the sub-frame from an operating position fully retracted into the machine to an extended position with a portion of the arms projecting at least partially through the chain train and out of the downstream end of the machine.

2. A machine according to claim 1, wherein the sub-frame of the pair of arms is mounted at one end of the arms by an axle situated slightly above and upstream of the downstream return wheel for the chain train, the operating retracted position being approximately horizontal and oriented in an upstream direction of the machine, and the extended position being reached after rotation through an angle between 100° and 200° upward and into a downstream direction of the machine.

3. A machine according to claim 2, wherein each of the arms separates at a median part into two branches, of which one branch, when the sub-frame is in the retracted position within the machine, is approximately horizontal and the other branch is oriented upward in a direction approximately parallel to the chain of the chain train for the clamping bars as the chain leave the return wheel, each of the branches terminating in a base plate for supporting an end of an axle for the bobbin, and each of the arms having a third base plate at the junction between the two branches, said frame including at least three support crossbeams, each spaced a distance of a support lever from the three base plates for supporting axles for small bobbins.

4. A machine according to claim 3, wherein upward orientation of the second branch as well as the path of the chains of the chain train leaving the downstream return wheel form an angle of between 40° and 80° in relation to a horizontal plane.

5. A machine according to claim 3, wherein each of the arms has a U-shaped portion forming an upwardly extending recess between the axle of the sub-frame and the junction of the branches.

6. A machine according to claim 3, wherein each of the base plates has a slot with a trapezoidal shape and, when the arms are in the retracted operating position, each shape has a lower edge making an angle of substantially 45° with a horizontal, a downstream edge making an angle of substantially 100° and an upper edge making an angle of substantially 15°, with the opening of the slot opening upstream, for receiving ends of rigid support axles for the bobbins, which ends have a triangular cross section.

7. A machine according to claim 1, wherein the drive means comprises an electric motor having a drive shaft being mounted on one of the lateral walls of the last station of the machine, said drive shaft being connected by means for transferring rotational motion to an axle secured to the sub-frame and being mounted in the frame of the machine for rotation.

8. A machine according to claim 7, wherein the drive means includes an intermediate gear wheel connected by a chain belt to a gear wheel mounted on the output shaft of the motor, said intermediate gear wheel being on a second axle having a gear wheel connected by a belt arrangement to a gear wheel on the axle of the sub-time, a second wheel being mounted on the intermediate shaft providing a double-earn cooperating with followers of two contractors mounted adjustably relative to the second wheel, one of said contractors creating a stop signal when the time is turned to the operating position and the other contractor creating a stop signal when the frame is turned to the extended position.

* * * * *